US007014694B1

(12) United States Patent
Miksic et al.

(10) Patent No.: US 7,014,694 B1
(45) Date of Patent: Mar. 21, 2006

(54) OIL-BASED ADDITIVE FOR CORROSION INHIBITORS

(75) Inventors: Boris A. Miksic, North Oaks, MN (US); Alla Furman, Shoreview, MN (US); Margarita Kharshan, Little Canada, MN (US); Lee Boutelle, Katy, TX (US)

(73) Assignee: Cortec Corporation, St. Paul, MN (US)

( * ) Notice: Subject to any disclaimer, the term of this patent is extended or adjusted under 35 U.S.C. 154(b) by 115 days.

(21) Appl. No.: 10/410,706

(22) Filed: Apr. 9, 2003

(51) Int. Cl.
*C01M 135/10* (2006.01)
*C10M 141/08* (2006.01)
*C10M 141/10* (2006.01)
*C10M 145/00* (2006.01)

(52) U.S. Cl. ..... 106/14.22; 106/14.05; 106/14.23; 106/14.24; 106/14.41; 252/70; 508/128; 508/153; 508/179; 508/237

(58) Field of Classification Search ..... 106/14.05, 106/14.22, 14.23, 14.24, 14.41; 252/70; 508/128, 153, 179, 237
See application file for complete search history.

(56) References Cited

U.S. PATENT DOCUMENTS

| | | | | |
|---|---|---|---|---|
| 4,956,122 | A * | 9/1990 | Watts et al. | 508/485 |
| 5,744,430 | A * | 4/1998 | Inoue et al. | 508/295 |
| 6,180,575 | B1 * | 1/2001 | Nipe | 508/227 |
| 6,620,772 | B1 * | 9/2003 | Garmier | 508/491 |

* cited by examiner

*Primary Examiner*—Yogendra N. Gupta
*Assistant Examiner*—Kallambella Vijayakumar

(74) *Attorney, Agent, or Firm*—Haugen Law Firm PLLP

(57) ABSTRACT

An oil-based corrosion inhibitor composition for use in lubricating and/or hydraulic oils includes an oil-soluble sulfonate salt, an imidazoline salt of a fatty acid or a poly acid, and a polymerized ester, with the corrosion inhibitor composition being diluted with a polyalphaolefin to a suitable viscosity for subsequent use as an additive to such oils. In preferred embodiments, the corrosion inhibiting additive composition is mixed with the lubricating and/or hydraulic oils at a concentration of between about 2–5% by weight of the combination.

2 Claims, No Drawings

OIL-BASED ADDITIVE FOR CORROSION INHIBITORS

BACKGROUND OF THE INVENTION

The present invention relates to oil-based corrosion inhibitor additives for combination with lubricating or hydraulic oils. When added to the oils at a concentration of between about 2–5% by weight, the combination enhances protection of ferrous and nonferrous metals. The additives effectively prevent corrosion of engines during intermittent operation and storage, and decrease high-temperature oxidation during use. This new inhibitor system is low in toxicity, is thermally stable and provides long-term corrosion protection. It further provides protection in the presence of chlorides and does not affect oil pour point and viscosity at low temperatures.

SUMMARY OF THE INVENTION

The oil used in auto and truck engines is becoming a significant cost factor in engine operation, including periodic oil replacement and disposal, and in oil recovery and re-use costs. An increase in the effective life of oil due to the oxidation resistant feature contributed by the inhibitor additives of the present invention is especially useful for requiring fewer oil changes, thereby providing significant cost savings.

The inhibitor additives, when diluted with oil to a viscous state, is especially useful as an additive to hydraulic oils and gear lubricants. Further dilution produces an oil suitable for coating machinery exposed to the environment or in storage. For example, the additive composition may be introduced into oils that are diluted to viscosities useful in coating or spray operations so as to protect, e.g., machinery used on oil rigs in marine environments. In such a manner, the additive composition of the present invention may be utilized in oil to assist in corrosion protection as well as to enhance oil lubricity for reducing wear in moving parts incorporating an oil lubricator.

DESCRIPTION OF THE PREFERRED EMBODIMENT

The corrosion-inhibiting and lubricating additive composition of the present invention preferably includes an oil soluble sulfonate salt, an imidazoline salt of a poly acid or fatty acid, and a high molecular weight polymerized ester. Corrosion control is primarily addressed through the sulfonate and imidazoline components, while lubricity is primarily achieved with the high molecular weight ester component. The polymerized ester component is preferably a highly saturated polymer chain having a molecular weight of between about 35–750, and more preferably between about 250–600 grams per mole. In a particular embodiment of the invention, the polymerized ester component has a molecular weight of about 500 grams per mole. For typical application in lubricating and hydraulic oil systems, the composition is preferably added at a 2–5% by weight concentration level.

The first embodiment of the invention is an oil-soluble corrosion inhibitor composition, comprising an oil-soluble sulfonate salt, an imidazoline salt of polyaspartic acid and a polymerized ester, the corrosion inhibitor composition being diluted with a polyalphaolefin to form an additive mixture having a viscosity suitable for blending with a respective oil in which said composition is mixed wherein said composition includes about:

| | |
|---|---|
| calcium dinonylnaphthalene sulfonate | 30 parts |
| imidazoline/polyaspartic acid | 1 part |
| polymerized ester | 1–5 parts |
| polyalphaolefin | balance |

The second embodiment of the invention is an oil-soluble corrosion inhibitor composition, comprising an oil-soluble sulfonate salt, an imidazoline salt of succinic acid, and a polymerized ester, said corrosion inhibitor composition being diluted with polyalphaolefin to form an additive mixture having a viscosity suitable for blending with a respective oil in which said composition is mixed, wherein said composition includes about:

| | |
|---|---|
| calcium dinonylnaphthalene sulfonate | 30 parts |
| imidazoline/succinic acid | 1 part |
| polymerized ester | 1 part |
| polyalphaolefin | balance |

EXAMPLE I

A formulation in accordance with the present invention was prepared by blending the following components, which are combined with a polyalphaolefin oil such as conventional mineral oil or motor oil to a viscosity suitable for easy dilution if required.

| | | |
|---|---|---|
| Calcium dinonylnaphthalene sulfonate | 2–5 parts | Na-Sul ® CA-HT3, King Industries, Inc. |
| Imidazoline/ aspartic acid | 0.05–0.1 parts | Colacor93, Colonial Chemical, Inc. |
| Polymerized Ester | 0.1–0.5 parts | Syn-Ester ® GY500, Lubrizol |
| Polyalphaolefin | 25–30 parts | Ashland. |

EXAMPLE II

A phosphorous-containing component may be added to the composition for enhanced lubricating properties. Preferably, the addition of 1 part oil-soluble, phosphate ester (free acid form) to 6 parts polymerized ester enhances lubricity.

| | | |
|---|---|---|
| Calcium dinonylnaphthalene Sulfonate | 2–4 parts | Na-Sul ® CA-HT3, King Industries, Inc. |
| Imidazoline/ aspartic acid | 0.05–0.1 parts | Colacor93, Colonial Chemical, Inc. |
| Polymerized Ester | 0.2–0.6 parts | SynEster ® GY500, Lubrizol |
| Oil-Soluble phosphate ester | 0.05–0.1 parts | Addco ®-360 P, Lubrizol |
| Polyalphaolefin | 95–98 parts | Castrol Oil. |

EXAMPLE III

A further formulation of the present invention exhibiting enhanced corrosion inhibiting characteristics was prepared with the imidazoline salt of succinic acid.

| | | |
|---|---|---|
| Calcium dinonylnaphthalene sulfonate | 1–5 parts | Alox 606, Lubrizol |
| Imidazoline | 0.1–0.2 parts | Witcamine 209, Witco |
| Succinic acid | 0.05–0.1 parts | |
| Polymerized Ester | 0.1–0.5 parts | SynEster GY500, Lubrizol |
| Polyalphaolefin | 92–95 parts | Castrol Oil. |

Laboratory Testing

The three compositions were tested in the Cummins high temperature corrosion bench test and multimetal Cummins bench corrosion test with no adverse affect on oil. ASTM D 1748 testing of a 2% addition of the formulation of Example I to Castrol Dieselall SAE 10W30 and SAE 15W40 engine oil showed improved protection of carbon steel and copper in a humid atmosphere. A Ball Run Test on carbon steel in acidic conditions showed good protection.

Gasoline Engine Field Testing

Long term comprehensive testing was performed in a 1999 Ford Lincoln Continental with a gasoline powered V-8 engine. Two tests were performed with Castrol Heavy Duty 10W-30 oil for 3000 miles with the additive formulation of Example II and a control. There was a complete analysis performed every 1000 miles on oil samples drawn for the crankcase. The analysis included ICP metals, water and fuel contamination, solids, TBN, TAN, oxidation, and viscosity. One pint of each final drain was collected for humidity cabinet testing of the used oil. The ICP metals graph shows that there are no negative effects from using the additive-enhanced oil as compared to the control. In addition, there was less copper present in each of the 1000, 2000, and 3000 mile samples from the additive formulation oil as compared to the control. There was no increase in the amount of lead or tin, which are used to make bearings. The iron and aluminum results fell within normal parameters irrespective of the additive.

The chemical and physical parameters data did not show any adverse effects when using the additive formulations of the present invention. There was no sign of water or water induced gelling. The solids levels were within normal range. The Total Base Number (TBN) tracked well with both the TAN and the total oxidation, and the viscosity in all cases demonstrated no pro-oxidative behavior with the addition of the present formulations in the oil.

Diesel Engine Field Testing

An extended test in a Cummins diesel engine in motor transport operation gave positive results with the formulations of the present invention showing better oxidation resistance results even though the comparisons were made after a 15% longer run time on the test sample than the control. The oils were analyzed for chromium, iron, copper, lead, zinc, aluminum and silicon. Copper, aluminum and silicon were similar in both the control and the test sample but the test sample showed zinc was 7% less, iron was 10% less, lead was 25% less and chromium was 33%. These results indicate that the additive formulations significantly increase the oxidation resistance when added to a diesel engine lubricating oil.

What is claimed is:

1. An oil-soluble corrosion inhibitor composition, comprising an oil-soluble sulfonate salt, an imidazoline salt of polyaspartic acid, and a polymerized ester, the corrosion inhibitor composition being diluted with a polyalphaolefin to form an additive mixture having a viscosity suitable for blending with a respective oil in which said composition is mixed, wherein said composition includes about:

| | |
|---|---|
| calcium dinonylnaphthalene sulfonate | 30 parts |
| imidazoline/polyaspartic acid | 1 part |
| polymerized ester | 1–5 parts |
| polyalphaolefin | balance |

2. An oil-soluble corrosion inhibitor composition, comprising an oil-soluble sulfonate salt, an imidazoline salt of succinic acid, and a polymerized ester, said corrosion inhibitor composition being diluted with a polyalphaolefin to form an additive mixture having a viscosity suitable for blending with a respective oil in which said composition is mixed, wherein said composition includes about:

| | |
|---|---|
| calcium dinonylnaphthalene sulfonate | 30 parts |
| imidazoline/succinic acid | 1 part |
| polymerized ester | 1 part |
| polyalphaoletin | balance |

* * * * *